US009127687B2

(12) United States Patent
Fujimoto et al.

(10) Patent No.: US 9,127,687 B2
(45) Date of Patent: Sep. 8, 2015

(54) CENTRIFUGAL FAN

(75) Inventors: Seiya Fujimoto, Nagano (JP); Takako Fukuda, Nagano (JP); Yuzuru Suzuki, Nagano (JP); Masaki Ogushi, Nagano (JP)

(73) Assignee: Minebea Co., Ltd., Nagano (JP)

( * ) Notice: Subject to any disclaimer, the term of this patent is extended or adjusted under 35 U.S.C. 154(b) by 299 days.

(21) Appl. No.: 13/567,232

(22) Filed: Aug. 6, 2012

(65) Prior Publication Data

US 2013/0052049 A1 Feb. 28, 2013

(30) Foreign Application Priority Data

Aug. 29, 2011 (JP) ..... 2011-185957

(51) Int. Cl.

| | |
|---|---|
| ***F04D 17/16*** | (2006.01) |
| ***F04D 25/06*** | (2006.01) |
| ***F04D 25/08*** | (2006.01) |
| ***F04D 29/42*** | (2006.01) |
| ***F04D 29/28*** | (2006.01) |
| ***F04D 29/30*** | (2006.01) |

(52) U.S. Cl.

CPC ..... *F04D 25/0613* (2013.01); *F04D 17/16* (2013.01); *F04D 25/08* (2013.01); *F04D 29/281* (2013.01); *F04D 29/30* (2013.01); *F04D 29/4226* (2013.01)

(58) Field of Classification Search

CPC . F04D 25/0613; F04D 17/16; F04D 13/0673; F04D 29/282; F04D 17/165; F04D 19/002; F04D 29/281; F04D 29/30; F04D 29/403; F04D 29/42; F04D 29/4206; F04D 29/4226; F04D 29/424; F04D 25/0646; F04D 25/08; F04D 17/08; F04D 17/10; F04D 17/162; F04D 17/00; F04D 29/02

USPC ..... 417/352, 353, 354, 423.14

See application file for complete search history.

(56) References Cited

U.S. PATENT DOCUMENTS 5,597,034 A * 1/1997 Barker et al. ..... 165/80.3
5,979,541 A * 11/1999 Saito ..... 165/80.3

(Continued)

FOREIGN PATENT DOCUMENTS

| | | | |
|---|---|---|---|
| JP | 63-289295 | A | 11/1988 |
| JP | 2002-195197 | A | 7/2002 |
| JP | 2008-286036 | A | 11/2008 |

OTHER PUBLICATIONS

Office Action dated Feb. 17, 2015 issued in the counterpart JP Patent Application 2011-185957.

*Primary Examiner* — Bryan Lettman

(74) *Attorney, Agent, or Firm* — Carrier Blackman & Associates, P.C.; Joseph P. Carrier; William D. Blackman

(57) ABSTRACT

In a centrifugal fan, a casing includes: a top plate; a motor base configured to serve as a bottom plate; and a plurality of support members provided between the top plate and the motor base, wherein an opening functioning as an air outlet opening is formed at each side of the casing so as to be surrounded by adjacent support members, the top plate and the motor base, and an impeller, which is housed between the top plate and the motor base of the casing, includes: an annular shroud; and a plurality of blades arranged in the circumferential direction and provided under the shroud, wherein at least one part of each blade opposes directly the motor base of the casing, and wherein the motor base opposes the lower parts of the blades in the direction of a rotary shaft of the impeller with a predetermined air gap provided therebetween.

10 Claims, 4 Drawing Sheets

(56) References Cited

U.S. PATENT DOCUMENTS

| | | | | |
|---|---|---|---|---|
| 6,503,055 | B1 | 1/2003 | Gerenski et al. | |
| 6,551,074 | B2 * | 4/2003 | Kudo et al. | 417/354 |
| 6,802,699 | B2 * | 10/2004 | Mikami et al. | 417/369 |
| 7,063,504 | B2 * | 6/2006 | Huang et al. | 415/165 |
| 7,108,482 | B2 * | 9/2006 | Chapman | 416/185 |
| 2005/0058543 | A1 * | 3/2005 | Takeshita et al. | 415/206 |
| 2009/0142190 | A1 * | 6/2009 | Horng et al. | 415/200 |

* cited by examiner

| Centrifugal fan structure | Noise Level [dB(A)] |
|---|---|
| Comparative example 1 (Scroll casing) | 61 |
| Comparative example 2 (Gap Length G=0) | 57.3 |
| Embodiment of the present invention (Gap Length G=0.5mm) | 58 |

CENTRIFUGAL FAN

BACKGROUND OF THE INVENTION

1. Field of the Invention

The present invention relates to a centrifugal fan, and particularly a centrifugal fan in which noises attributable to air blowing are reduced and also cost is reduced.

2. Description of the Related Art

A centrifugal fan is structured to include: a scroll casing which includes an air inlet opening and an air outlet opening; and an impeller which is housed in the scroll casing. The impeller is structured such that a number of blades are arranged around the circumference of a rotary shaft of a motor.

The centrifugal fan operates in such a manner that air is taken in through the air inlet opening of the scroll casing, moved from the center of the impeller through between the blades and then emitted in the radially outward direction of the impeller by hydrodynamic force generated by centrifugal action resulting from the rotation of the impeller. The air emitted out from the outer circumference of the impeller is caused to travel inside the scroll casing and is blown out through the air outlet opening as high-pressure air.

The centrifugal fan is widely used for cooling household electric appliances, office automation equipment or industrial equipment, for air ventilation or air conditioning, and is also used as an air blower for vehicles. The blast performance and noise level of the centrifugal fan are largely influenced by the blade shape of the impeller and the shape of the scroll casing (namely, the structure of the centrifugal fan).

Various approaches have conventionally been made for optimizing the impeller blade shape and the scroll casing structure for the purpose of reducing the noise level and enhancing the blast performance. In one conventional approach, a centrifugal fan is proposed in which the shape of impeller blades is optimized to thereby reduce noise level (refer to, for example, Japanese Patent Application Laid-Open No. S63-289295).

FIG. 6 shows in plan a cutaway view of the aforementioned centrifugal fan disclosed in Japanese Patent Application Laid-Open No. S63-289295, and FIG. 7 shows perspectively an impeller of the centrifugal fan shown in FIG. 6.

Referring to FIGS. 6 and 7, an impeller 120 of a centrifugal fan 100 includes a primary plate 121, a secondary plate 122, and a plurality of blades 123 arranged between the primary plate 121 and the secondary plate 122. When the impeller 120 rotates (in the counterclockwise direction in FIG. 6), the outer circumferential portion of the blade 123 rotates behind the inner circumferential portion of the blade 123. The impeller 120 is attached inside a casing 127 having a scroll shape, and air is blown.

The air to be blown is taken in through an air inlet opening 140 and emitted from the outer circumference of the impeller 120 by hydrodynamic force generated by centrifugal action by means of the blades 123 of the impeller 120. The pressure of the air emitted out from the outer circumference of the impeller 120 is increased by means of the scroll-shaped casing 127 and then is blown out through an air outlet opening 141.

The impeller 120 thus has what is called a backward inclined blade structure in which, as described above, the outer circumferential portion of the blade 123 rotates behind the inner circumferential portion of the blade 123 with respect to the rotation direction of the impeller 120. Namely, as shown in FIG. 6, the blade 123 is curved to be inclined backward with respect to the rotation direction of the impeller 120. A centrifugal fan which is provided with the impeller blade structure described above is generally called a turbo-fan.

In the turbo-fan (centrifugal fan 100) shown in FIG. 6, the plurality of blades 123 are sandwiched between the primary plate 121 and the secondary plate 122 which has a diameter identical to the diameter of the primary plate 121.

The blade 123 has a trailing edge obliquely cut off so that a curved side 135 positioned at the primary plate 121 is shorter than a curved side 134 positioned at the secondary plate 122. As a result, a time lag is generated between a time when a trailing edge portion 131 positioned at the primary plate 121 passes by a casing tongue 129 and a time when a trailing edge portion 132 positioned at the secondary plate 122 passes by the casing tongue 129.

Consequently, as described in Japanese Patent Application Laid-Open No. S63-289295, the pressure variation caused by the blade 123 passing by the casing tongue 129 can be temporally dispersed and so the energy to produce sound is dispersed thus reducing generation of noises.

In the above turbo-fan described in Japanese Patent Application Laid-Open No. S63-289295, the shape of the blade 123 is optimally modified in order to reduce noises produced when air is blown. In the scroll-shaped casing 126, however, the casing tongue 129 is formed, and noises which are produced when the air emitted from the impeller hits the casing tongue 129 cannot be satisfactorily reduced.

Also, in the turbo-fan described in Japanese Patent Application Laid-Open No. S63-289295, the air emitted from the outer circumference of the impeller 120 is caused to travel along the inner surface of the scroll-shaped casing 127 and to be blown out through the air outlet opening 141. Therefore, the air flow is likely to be disturbed at the inner surface of the scroll-shaped casing 127 and also near the air outlet opening, and the air flow disturbed there causes noise generation.

Further, recently, for the centrifugal fan used in an air blower for household electric appliances, office automation equipment or vehicles, cost reduction as well as noise reduction and miniaturization is strongly requested.

In the scroll-shaped casing 127 shown in FIG. 6, however, an air flow passage to conduct air to the air outlet opening 141 must be provided around the outer circumference of the impeller 120. Accordingly, the outer diameter of the scroll-shaped casing 127 has to be about twice as large as the outer diameter of the impeller 120, which, as a result, makes it difficult to downsize the turbo-fan.

The roll-scrolled casing 127 and the impeller 120 are generally made of synthetic resin, and due to the recent economic situation that the price of synthetic resin is increasing, there is a problem, in addition to the above described downsizing difficulty problem, that the cost of the centrifugal fan cannot be easily reduced.

SUMMARY OF THE INVENTION

The present invention has been made in light of the problems described above, and it is an object of the present invention to provide a centrifugal fan in which noises generated when air is blown are reduced and also in which size and cost are reduced.

In order to achieve the object described above, according to an aspect of the present invention, there is provided a centrifugal fan which includes: a motor; a casing; and an impeller housed in the casing. In the aforementioned centrifugal fan, the casing includes: a top plate; a motor base which is configured to work as a bottom plate and on which the motor is mounted; and a plurality of support members which are provided between the top plate and the motor base, wherein an opening is formed at each side of the casing so as to be surrounded by adjacent support members, the top plate and the motor base, and wherein the opening functions as an air outlet opening. Also, in the centrifugal fan, the impeller, which is housed in the casing so as to be located between the top plate and the motor base, includes: an annular shroud; and a plurality of blades which are arranged in the circumferential direction and which are provided under the shroud, wherein at least one part of each of the plurality of blades opposes directly the motor base of the casing with no component members intervening therebetween, and wherein the motor base opposes the lower parts of the plurality of blades in the direction of a rotary shaft of the impeller with a predetermined air gap provided therebetween. The centrifugal fan structured as described above operates in such a manner that when the motor rotates, air taken in through an air inlet opening is emitted in the radially outward direction of the impeller and blown out from the casing by centrifugal force resulting from the rotation of the motor.

In the aspect of the present invention, the air gap may preferably have a length of 0.5 mm or less, but the present invention is not limited thereto.

In the aspect of the present invention, the motor base may preferably be made of a metal plate, and include: a recess at a center thereof; and a side wall formed such that the outer circumferential rim of the motor base is bent in the direction of the rotary shaft of the impeller.

In the aspect of the present invention, the top plate and the support members of the casing may preferably be formed integrally by molding.

In the aspect of the present invention, the blades of the impeller may preferably be inclined backward with respect to the rotation direction of the impeller.

According to the present invention described above, a centrifugal fan can be provided in which noises attributable to air blowing are reduced and at the same time in which size and cost are reduced.

DETAILED DESCRIPTION OF THE INVENTION

Figure 1:
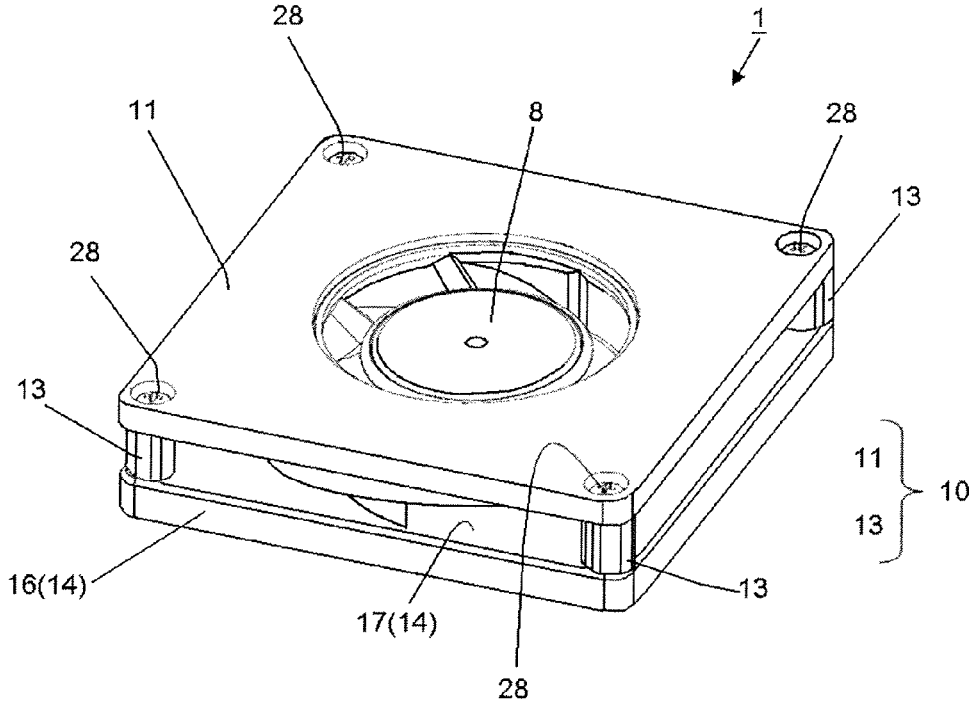
FIG. 1 is a perspective view of a centrifugal fan according to an embodiment of the present invention.

An exemplary embodiment of the present invention will hereinafter be described in conjunction with the accompanying drawings. FIG. 1 perspectively shows a centrifugal fan according to an embodiment of the present invention, FIG. 2 shows a half cross section of the centrifugal fan shown in FIG. 1, and FIG. 3 shows a cross section of an impeller of the centrifugal fan shown in FIG. 2.

Figure 2:
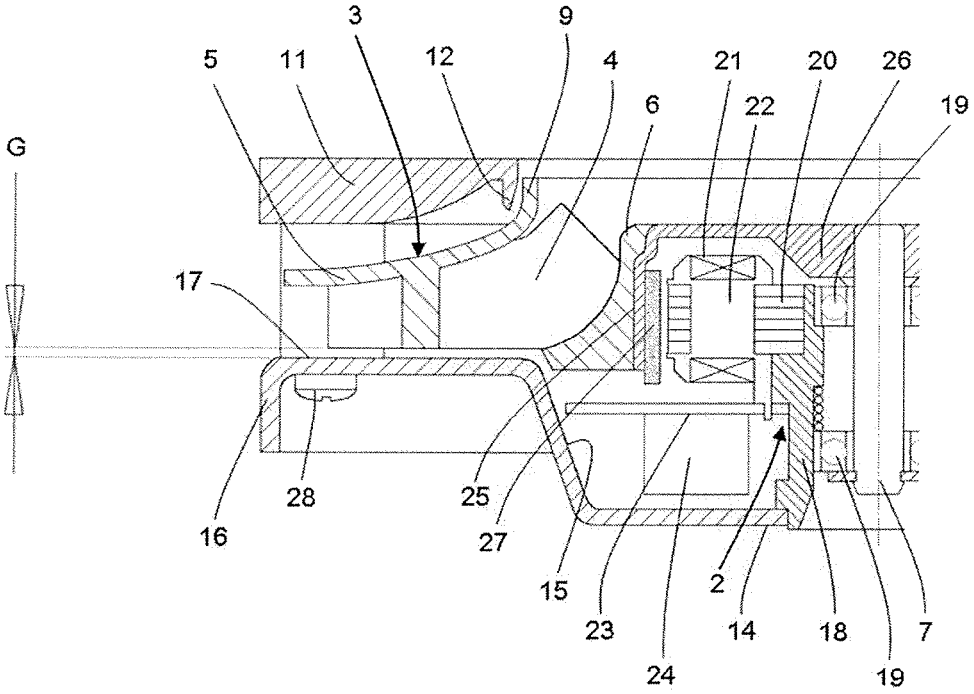
FIG. 2 is a half cross-sectional view of the centrifugal fan shown in FIG. 1.
Figure 3:
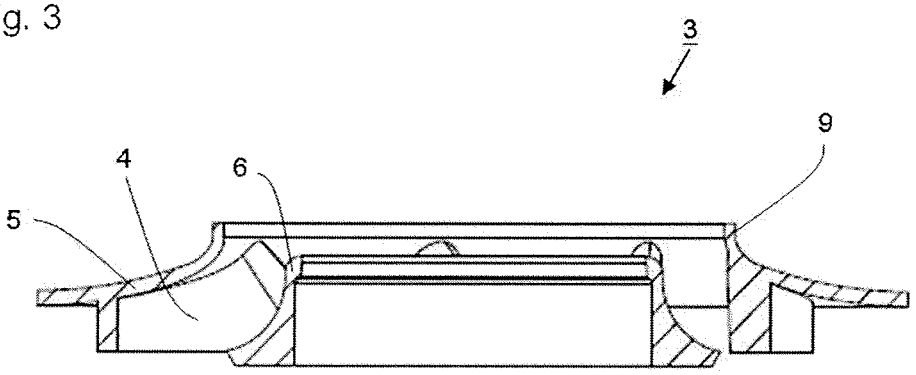
FIG. 3 is a cross-sectional view of an impeller shown in FIG. 2.

Referring to FIGS. 1 to 3, a centrifugal fan 1 according to the embodiment of the present invention includes: an impeller 3 which is provided with a plurality of blades 4; and a casing 10 to house the impeller 3. The impeller 3 is rotated by a motor 2.

The impeller 3 is structured such that the blades 4 are positioned to lie equidistantly to one another in the circumferential direction and one sides of the blades 4 are supported by an annular shroud 5. In this connection, the earlier described primary plate 121 shown in FIG. 7 (conventional art) is not provided at the other sides of the blades 4. The annular shroud 5 has an upper surface formed with a predetermined curve and includes a hollow circular cylinder 9 at the center, and an air inlet opening 8 is constituted by a space formed inside the hollow circular cylinder 9.

Figure 6:
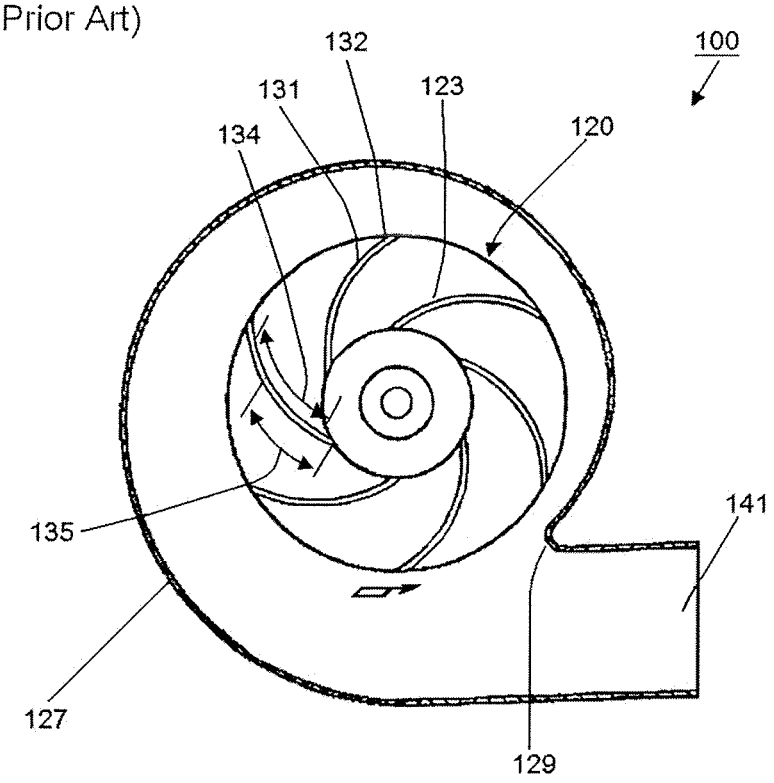
Fig. 6 (Prior Art)
FIG. 6 is a plan cutaway view of a conventional centrifugal fan.

The impeller 3 includes a cup-shaped boss 6 at the center. The blades 4 have a curved configuration with a predetermined curvature and are shaped identically to one another. The blades 4 are formed into a backward inclined blade structure, specifically are each curved to be inclined backward with respect to the rotation direction of the impeller 3 in the same manner as shown in FIG. 6, thus forming a turbofan.

The blades 4, the annular shroud 5 and the boss 6 are integrally formed of synthetic resin by molding. A rotor of the motor 2 is fixed to the inside of the cup-shaped boss 6. The impeller 3 is caused to rotate when the motor 2 rotates.

The casing 10 has a quadrangular shape. The casing 10 includes a top plate 11 which is made of synthetic resin and which has a circular opening at the center thereof. Four support members 13, which have a substantially circular cylindrical shape, are provided respectively near at four corners of the top plate 11.

A barb portion 12 to protrude downward is formed along the perimeter of the opening of the top plate 11. The hollow circular cylinder 9 of the shroud 5 is arranged inside the barb portion 12 (closer toward the rotary shaft of the impeller 3) in such a manner that a predetermined air gap is provided between the cylinder 9 and the barb portion 12.

A motor base 14 is arranged so as to oppose the top plate 11, wherein the four support members 13 are sandwiched between the top plate 11 and the motor base 14. The support members 13 are fixedly connected to the top plate 11 by means of connecting members 28 (for example, bolts, screws, rivets or the like). The support members 13 are also fixedly connected to the motor base 14 by means of the connecting members 28 (for example, bolts, screws, rivets or the like).

Alternatively, the top plate 11 and the support members 13 may be integrally made by molding, and the support members 13 and the motor base 14 may be connected to each other by the connecting members 28.

An opening is formed to be surrounded by two adjacent support members 13, the top plate 11 and the motor base 14. The opening formed as described above functions as an air outlet opening.

The opening described above is formed at each of the four sides of the casing 10 of the centrifugal fan 1 according to the present embodiment. Thus, the casing 10 has only the support members 13 at the sides thereof (whereby openings are formed except at portions where the support members 13 are located).

The outer diameter of the impeller 3 which is housed in the casing 10 is set to be smaller than the dimension of one side of the casing 10. If the outer diameter of the impeller 3 is larger than the dimension of one side of the casing 10, the impeller 3, when rotating, protrudes from the outer edge of the casing 10 and may come into contact with other component members thereby causing damages.

Therefore, it is preferable that the outer diameter of the impeller 3 is set so that the outermost portion of the blade 4 does not protrude from the outer edge of the casing 10.

The motor 2 is an outer rotor type brushless motor. The rotor of the motor 2 includes a rotor yoke 25 having a cup shape, a magnet 27 having a ring shape, and a shaft 7. The magnet 27 is fixedly attached to the inner circumferential surface of the rotor yoke 25. The shaft 7 is fixed to a boss 26 formed at the center of the rotor yoke 25.

The shaft 7 is rotatably supported by a pair of bearings 19 attached to a bearing holder 18. A stator core 20 of laminated structure is attached at the outer circumferential surface of the bearing holder 18. An insulator 22, around which a coil 21 is wound, is attached to the stator core 20. The bearing holder 18 is attached to the motor base 14.

The stator core 20 attached to the bearing holder 18 is arranged to oppose the magnet 27 with respect to the radial direction (horizontal direction in FIG. 2) wherein a predetermined air gap is provided between the stator core 20 and the magnet 27.

The motor base 14 is made of a metal plate (for example, iron plate) by pressing. The motor base 14 has a quadrangular shape in the same way as the casing 10, and has a recess 15 at the center. The outer rim of the motor base 14 is bent in the axial direction (vertical direction in FIG. 2) thereby forming a side wall 16.

By forming the side wall 16, the motor base 14 enhances its rigidity. The recess 15 of the motor base 14 has an opening at the center, and the motor 2 is housed in the recess 15 such that the bearing holder 18 is fitted in the opening. Correspondingly and as shown, when the bearing holder is fitted in the opening the recess 15 does not have an air intake opening defined therein.

The blades 4 of the impeller 3, which are connected to the rotor yoke 25, are arranged to oppose a plane portion 17 of the motor base 14 with respect to the axial direction (vertical direction in FIG. 2), wherein a predetermined gap length G is provided between the impeller 3 and the plane portion 17 of the motor base 14.

Specifically, at least a portion of the lower part of each of the plurality of blades 4 of the impeller 3 is exposed toward the plane portion 17 of the motor base 14. In this connection, the entire portion of the lower part of each blade 4 may be exposed toward the plane portion 17 of the motor base 14.

A printed circuit board (PCB) substrate 23 is attached at the lower face of the insulator 22. Electronic components 24 to drive the motor 2 in a controlled manner are mounted on the PCB substrate 23.

When the motor 2 is driven and the impeller 3 is rotated, the air taken in through the air inlet opening 8 is caused to pass through between the blades 4 of the impeller 3 and then to be blown out in the radially outward direction of the impeller 3 by hydrodynamic force generated by centrifugal action resulting from the rotation of the impeller 3.

Figure 7:
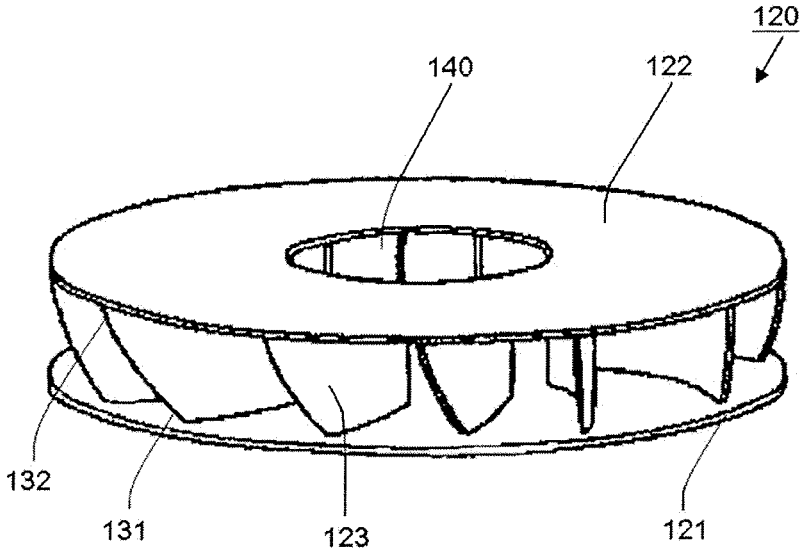
Fig. 7 (Prior Art)
FIG. 7 is a perspective view of an impeller of the conventional centrifugal fan shown in FIG. 6.

The motor base 14 substitutes for and serves as the primary plate 121 included in the conventional impeller 120 shown in FIG. 7 and at the same time serves as a bottom plate for the casing 10. Consequently, it is critical to optimally set the gap length G defined between the impeller 3 and the plane portion 17 of the motor base 14.

If the gap length G is too large, the air taken in through the air inlet opening 8 is caused not only to pass through between the blades 4 but also to flow into the air gap. As a result, the pressure of the air blown out from the impeller 3 is decreased and the blowing characteristic is degraded.

On the other hand, if the gap length G is too small, when the relevant component members are produced with variation in dimensional accuracy, it can happen that the blades 4 of the impeller 3 make contact with the plane portion 17 of the motor base 14. In order to avoid such a contact problem, the component members must be produced with an appropriate control to maintain a high dimensional accuracy, which eventually increases the cost of the centrifugal fan 1.

As described above, the gap length G is a critical factor to affect the blowing characteristic of a centrifugal fan. Specifically, the gap length G is appropriately set to optimize the balance between the blowing characteristic of the centrifugal fan and the manufacturing cost.

Figures 4, 5:
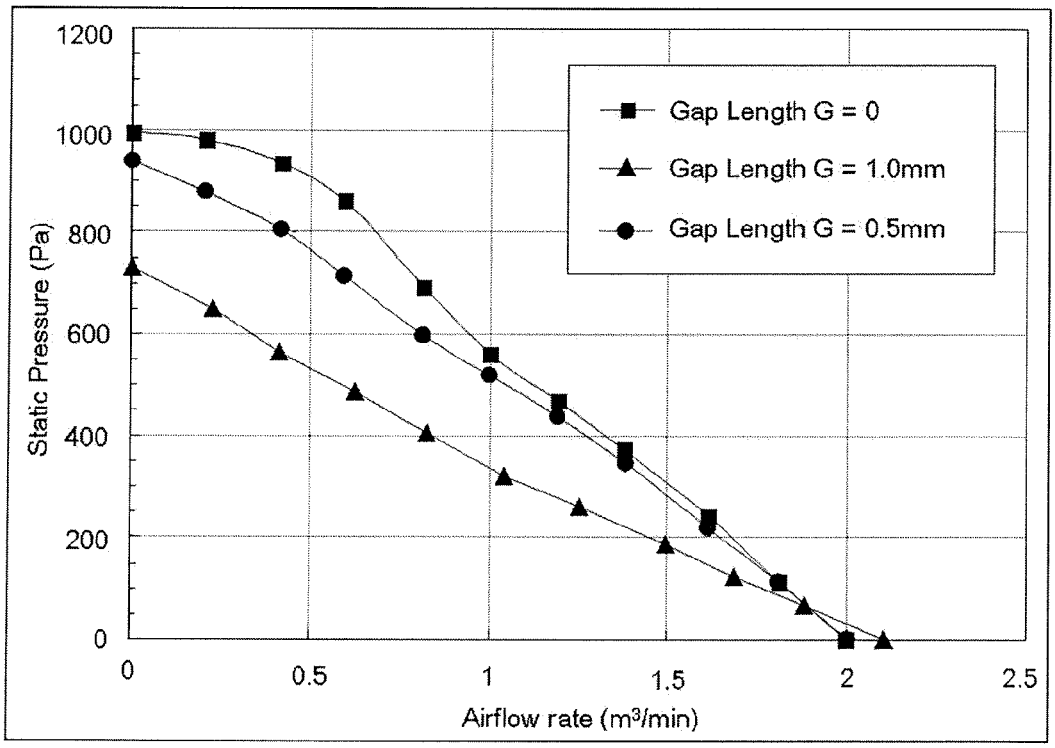
FIG. 4 is a table of noise measurements taken on the centrifugal fan according to the embodiment of the present invention and also taken on comparative example centrifugal fans.
FIG. 5 is a graph of characteristics of static pressure as a function of air flow observed on centrifugal fans provided with casings which are structured according to the embodiment of the present invention, where respective gap lengths provided differ from one another.

FIG. 4 shows measurements of noises taken on centrifugal fans prepared as comparative examples as well as on the centrifugal fan according to the embodiment of the present invention.

In FIG. 4, Comparative Example 1 refers to a centrifugal fan which is provided with a conventional scroll-shaped casing, and Comparative Example 2 refers to a centrifugal fan which, while provided with a quadrangular casing with openings formed at all sides in the same way as the centrifugal fan according to the embodiment of the present invention, incorporates an impeller structured differently from the impeller according to the embodiment of the present invention.

Specifically, the impeller of Comparative Example 2 includes an annular shroud located at one sides of blades and a primary plate (like the primary plate 121 shown in FIG. 7) located at the other sides of the blades. In Comparative Example 2, since the primary plate is provided, a motor base does not have to serve as a primary plate, and therefore the gap length G which enables the motor base to serve as a primary plate is not provided (thus, the distance between the lower side of the blade and the primary plate is 0 mm).

The "centrifugal fan according to the embodiment" referred to in FIG. 4 is the centrifugal fan described with reference to FIGS. 1 to 3 in which the gap length G between the impeller 3 and the plane portion 17 of the motor base 14 is set at 0.5 mm.

As shown in FIG. 4, the centrifugal fan of Comparative Example 1 provided with a conventional scroll-shaped casing has a noise level of 61 dB(A), the centrifugal fan of Comparative Example 2 has a noise level of 57.3 dB(A), and the centrifugal fan according to the embodiment has a noise level of 58 dB(A). Thus, it is known that noise is suppressed in the centrifugal fan according to the embodiment of the present invention.

FIG. 5 shows characteristics of static pressure as a function of air flow observed on centrifugal fans incorporating casings which are structured according to the embodiment of the present invention, specifically which have a quadrangular shape and have an opening formed at each of the four sides thereof (refer to the casing shown in FIG. 1), wherein respective gap lengths G provided between the impeller 3 and the plane portion 17 of the motor base 14 (refer to FIG. 2) differ from one another and are set at 1 mm, 0.5 mm, and 0 mm (no gap is provided). In FIG. 5, the horizontal axis refers to flow rate and the vertical axis refers to static pressure.

In this connection, "a gap length G of 0 mm (no gap is provided)" indicates that an impeller incorporated therein includes an annular shroud located at one ends of blades and a primary plate (like the primary plate 121 shown in FIG. 7) located at the other ends of blades.

According to FIG. 5, it is known that the maximum static pressure decreases with an increase in the gap length G defined between the impeller 3 and the plane portion 17 of the motor base 14. When the gap length G is 1 mm, the maximum static pressure decreases by about 25% compared to when the gap length G is 0 mm (no gap).

Also, when the gap length G is 0.5 mm, though the maximum static pressure decreases slightly compared to when the gap length G is 0 mm, it turns out that the characteristic relation between static pressure and air flow which is obtained when the gap length G is 0.5 mm is substantially comparable to the characteristic relation therebetween which is obtained when the gap length G is 0 mm (no gap).

From FIG. 5, it is known that when the gap length G between the impeller 3 and the plane portion 17 of the motor base 14 is set at 0.5 mm or less, the characteristic relation between static pressure and air flow becomes close to the characteristic relation therebetween which is obtained when the gap length G is 0 mm (no gap).

That is to say, it is necessary to optimally set the gap length G defined between the impeller 3 and the plane portion 17 of the motor base 14. Specifically, when the gap length G is set at 0.5 mm or less, the characteristic relation between static pressure and air flow becomes substantially comparable to the characteristic relation therebetween which is obtained when the gap length G is 0 mm (no gap).

As described above, the centrifugal fan according to the embodiment of the present invention includes an impeller which has a plurality of blades arranged therearound in the circumferential direction and which is housed in a casing, wherein when a motor is rotated, air taken in through an air inlet opening is emitted in the radially outward direction of the impeller and then blown out from the casing by centrifugal action resulting from the rotation of the impeller.

The casing includes a top plate, a motor base and a plurality of support members. The top plate and the motor base sandwich the plurality of support members. The sides of the casing are provided with only the support members and have respective openings. The motor base, on which the motor is mounted, constitutes or substitutes for a bottom plate of the casing.

The impeller includes an annular shroud and a plurality of blades made integrally with the shroud by molding. The motor base is arranged to oppose the plurality of blades with respect to the axial direction with a predetermined air gap provided therebetween.

In the centrifugal fan according to the embodiment of the present invention, the impeller is housed in the casing which is structured such that the top plate and the motor base are connected via the members. The casing described above, unlike the casing of the centrifugal fan shown in FIG. 6, is not provided with a side wall but has an opening at a portion corresponding to the side wall.

Consequently, it is prevented that the air blown out in the radially outward direction of the impeller is disturbed by the side wall of the casing. That is to say, by optimally modifying the shape of the casing, there can be provided a centrifugal fan in which noises attributable to the disturbance of air blown out are drastically reduced.

Specifically, the centrifugal fan according to the embodiment of the present invention incorporates, instead of a conventional scroll-shaped casing, a casing having a quadrangular shape, wherein the four sides of the casing are provided only with support members and are each otherwise occupied by an opening. Since the casing does not have a side wall, noise level can be reduced and also miniaturization can be achieved.

Further, in the centrifugal fan according to the embodiment of the present invention, the casing can be formed with an outer dimension measuring substantially identical to the outer dimension of the impeller, and therefore the radial dimension of the centrifugal fan can be reduced compared to a conventional centrifugal fan using a scroll-shaped casing.

Moreover, while the impeller 3 does not include a primary plate formed of synthetic resin and the casing 10 does not include a bottom plate formed of synthetic resin, the motor base 14, which is made of a metal plate and so can be produced at a low cost, functions as both a primary plate for the impeller 3 and a bottom plate for the casing 10.

Thus, the number of component members formed of synthetic resin can be reduced, and therefore the cost of manufacturing the centrifugal fan 1 can be drastically reduced, wherein, specifically, the motor base 14 is made of iron.

While the casing 10 has a square shape in the embodiment described above, the present invention is not limited to this shape arrangement. The casing 10 may have any arbitrary shape, such as a polygonal shape, a circular shape, or an asymmetric shape. The support member 13 does not have to be located within the outer edge of the top plate 11 of the casing 10 and may alternatively be arranged at a portion which is formed to protrude radially outwardly from the outer edge of the top plate 11.

Also, insofar as the support member 13 has a substantially circular cylinder shape dimensioned to allow the connecting members 28 to be inserted therein, the air emitted from the impeller 3 can be blown out from the sides of the casing 10 with little interference. With the support member 13 configured as described above, noises can be reduced.

It should be noted that the above described embodiment of the present invention is intended for presenting an exemplary illustration in every respect and that the present invention is by no means limited thereto. The scope of the present invention is specified not by the above description of the specific embodiment but by the appended claims of the present invention, wherein the present invention encompasses all modifications and equivalents that fall within the spirit and scope of the present invention.

What is claimed is:

1. A centrifugal fan comprising:

a motor;

a casing comprising: a top plate; a motor base which is configured to serve as a bottom plate and on which the motor is mounted; and a plurality of support members which are disposed between the top plate and the motor base at respective corners of the casing, wherein a single, unobstructed opening is formed at each side of the casing so as to be surrounded by adjacent support members, the top plate and the motor base, and wherein each of the single, unobstructed openings functions as an air outlet opening; and an impeller housed in the casing so as to be located between the top plate and the motor base, the impeller comprising: an annular shroud; and a plurality of blades which are arranged in a circumferential direction and which are disposed under the shroud, wherein the bottom plate comprises:

a recess arranged substantially at a center portion of the bottom plate and in which the motor is disposed;

a flat plate portion extending from a circumferential edge of the recess to an outer periphery of the bottom plate and which entirely covers an area in which lower parts of the plurality of blades rotate; and a side wall provided along the outer periphery of the bottom plate adjacent the support members and extending downward from the outer periphery of the bottom plate, wherein a bottom portion of the recess is arranged at a position axially below the side wall, wherein the plurality of blades directly oppose the flat plate portion of the motor base of the casing with no component members intervening therebetween and with a predetermined air gap provided therebetween in a direction of a rotary shaft of the impeller, and wherein when the motor rotates, air taken in through an air inlet opening is emitted in a radially outward direction of the impeller and blown out from the casing by centrifugal force resulting from rotation of the motor.

2. A centrifugal fan according to claim 1, wherein the top plate and the support members of the casing are in a form of an integral, unitary, molded member.

3. A centrifugal fan according to claim 1, wherein the blades of the impeller are inclined backward with respect to a rotation direction of the impeller.

4. A centrifugal fan according to claim 1, wherein the top plate has an opening at a center thereof, and a barb portion formed along a perimeter of the opening of the top plate, the barb portion protruding toward the motor base.

5. A centrifugal fan according to claim 1, wherein the casing has a quadrangular shape.

6. A centrifugal fan according to claim 1, wherein the motor base is made of a metal plate, wherein the recess and the side wall project away from a plane of the metal plate.

7. A centrifugal fan according to claim 1, wherein the recess is formed at a center of the motor base and the motor is fitted to the recess such that there is no air intake opening in the recess.

8. A centrifugal fan according to claim 1, wherein the predetermined air gap between the motor base and the lower parts of the plurality of blades is <0.5 mm.

9. A centrifugal fan according to claim 1, wherein the casing includes only one said opening formed at each side of the casing so as to be surrounded by adjacent support members, the top plate and the motor base.

10. A centrifugal fan according to claim 1, comprising:

a motor;

a casing comprising: a top plate; a motor base which is configured to serve as a bottom plate and on which the motor is mounted; and a plurality of support members which are disposed between the top plate and the motor base in spaced relation around an outer circumference of the casing, wherein a single, unobstructed opening is formed at each side of the casing so as to be surrounded by adjacent support members, the top plate and the motor base, and wherein each of the single, unobstructed openings functions as an air outlet opening; and an impeller housed in the casing so as to be located between the top plate and the motor base, the impeller comprising: an annular shroud; and a plurality of blades which are arranged in a circumferential direction and which are disposed under the shroud, wherein the bottom plate comprises:

a recess arranged substantially at a center portion of the bottom plate and in which the motor is disposed;

a flat plate portion extending from a circumferential edge of the recess to an outer periphery of the bottom plate and which entirely covers an area where lower parts of the plurality of blades rotate; and a side wall provided along the outer periphery of the bottom plate adjacent the support members and extending downward from the outer periphery of the bottom plate, wherein a bottom portion of the recess is arranged at a position axially below the side wall, wherein the plurality of blades directly oppose the flat plate portion of the motor base of the casing with no component members intervening therebetween and with a predetermined air gap provided therebetween in a direction of a rotary shaft of the impeller, and wherein when the motor rotates, air taken in through an air inlet opening is emitted in a radially outward direction of the impeller and blown out from the casing by centrifugal force resulting from rotation of the motor, and wherein the casing has a circular shape.

* * * * *